United States Patent [19]

Wirschal

[11] 4,357,121

[45] Nov. 2, 1982

[54] FLAP-GATE FOR BOTTOM DISCHARGE CONTROL IN CANALS HAVING ICE PROBLEMS

[75] Inventor: Helmut H. Wirschal, York, Pa.

[73] Assignee: Allis-Chalmers Corporation, Milwaukee, Wis.

[21] Appl. No.: 203,536

[22] Filed: Nov. 3, 1980

[51] Int. Cl.[3] ..... E02B 7/42

[52] U.S. Cl. ..... 405/100; 405/61

[58] Field of Search ..... 405/87, 99, 100, 61, 405/101

[56] References Cited

U.S. PATENT DOCUMENTS 1,587,616 6/1926 Sudler ..... 405/100

FOREIGN PATENT DOCUMENTS 218963 1/1962 Austria ..... 405/100
1146457 3/1963 Fed. Rep. of Germany ..... 405/100
481667 11/1975 U.S.S.R. ..... 405/100

*Primary Examiner*—David H. Corbin
*Attorney, Agent, or Firm*—Timothy R. Conrad

[57] ABSTRACT

Rotating flow control flap-gate in a water canal provides a rotating motion to overcome ice friction without additional ice prevention provisions, to permit water flow in the canal below the ice cover.

5 Claims, 4 Drawing Figures

FLAP-GATE FOR BOTTOM DISCHARGE CONTROL IN CANALS HAVING ICE PROBLEMS

RELATED APPLICATIONS

This application is related to the following copending U.S. patent applications: "Flap-Gate For Discharge Side of a Turbine Having No Wicket Gates" Ser. No. 203,113, filed 11-3-80, "Self Closing Flow Control Flap-Gate of a Turbine Having No Wicket Gates" Ser. No. 203,538 filed 11-3-80, and "Radial Gate Having Fine Tuning of Flow Control" Ser. No. 203,537 filed 11-3-80.

BACKGROUND OF THE INVENTION

Generally, flow in a canal is controlled by vertical lift gates or radial gates. These types of gates in ice areas present freeze-in problems and cannot be operated without special protection or precautions. In some ice ares, ice is encountered in such large quantities that it must be cut and sluiced away. This involves considerable expense and waste of water and energy. In other areas where lesser freezing conditions exist, small amounts of steam or electric heat are provided inside of the gate. This, of course, requires special construction and equipment which is costly to install and to operate as well as to maintain. In some installations an open channel clear of ice is maintained along the upstream face of the gate. This has been accomplished by electric heaters or lamps in reflectors just above the water surface and providing a covering over the heat source. Also air bubble systems to maintain the face of the gate free of ice have been utilized. This method requires the provision of perforated pipes or nozzles installed along the lower upstream face of the gate and supplied with air under pressure. The air bubbles create a circulation of warmer bottom water to the surface which serves to melt the cap ice or at least weaken the cap ice to an extent that the gates can be moved.

SUMMARY OF THE INVENTION

In canals or penstocks located in areas of ice problems it is advantageous to be able to pass the water from the lower part of the reservoir or canal through the gate so as to secure a flow of warmer water which will act on the upper ice formation to melt or weaken the ice.

It is presently considered advantageous to provide a water canal or the like with a rotatable flow control device wherein the rotational movement of the flow control device will overcome the ice friction when moved to an open position. Such a flow control device is conceived as being a rotatable flap-gate having the major portion of the upstream water surface face below the ice. With the rotation of the flap-gate to an open position, only a relatively small area of the gate is within the grip of the ice and the rotational drive of the gate is sufficient to overcome the ice friction allowing the gate to open to permit the flow of warmer bottom water through the gate.

DESCRIPTION OF THE INVENTION

Figure 1:
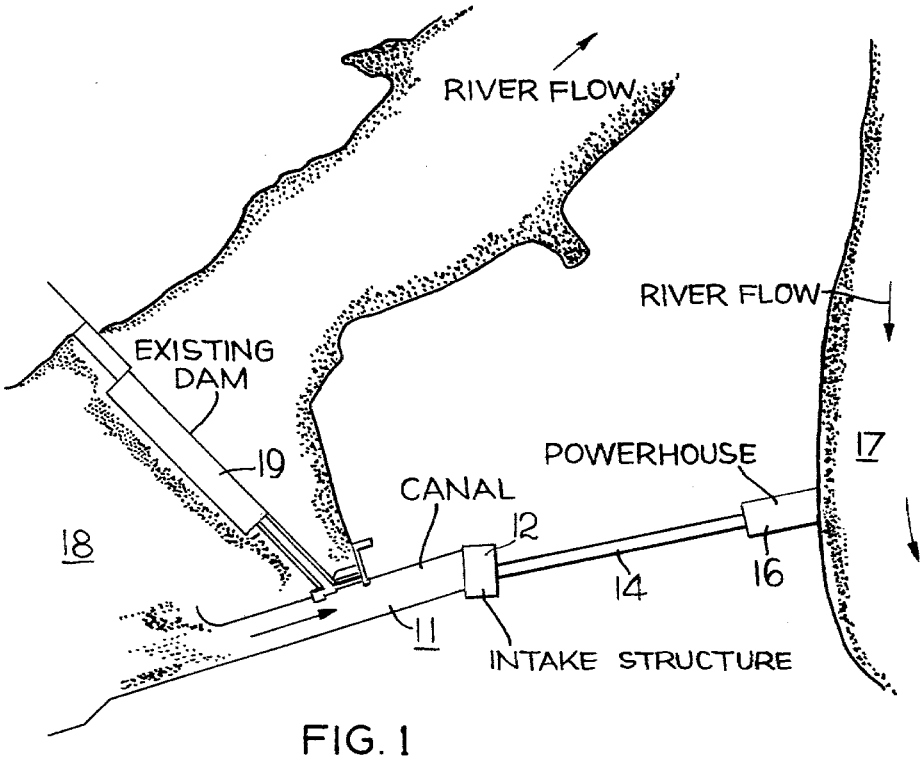
FIG. 1 is a schematic plan view of a power installation in which the present invention is incorporated.

As shown in FIG. 1, the flow-control flap-gate of the present invention is installed in a canal 11 leading into an intake structure or penstock 12. A water passageway 14 is connected to the penstock 12 and directs water flow to a turbine (not shown) located in a powerhouse sited at the shoreline of a river 17. The canal 11 receives water from a reservoir 18 created by a dam installation 19. The site herein shown is subject to icing conditions which interferes with the control of water through the canal 11 to the powerhouse 16.

In prior installations, vertical or radial flow control gates are utilized to control water flow and these gates experience a great deal of problems with ice. Special procedure and equipment are needed to free these control devices from the grip of ice. It has been conceived to provide a simple and positive acting flap gate arrangement 20 in the canal 11 for controlling the flow of water into the penstock 12.

Figure 2:
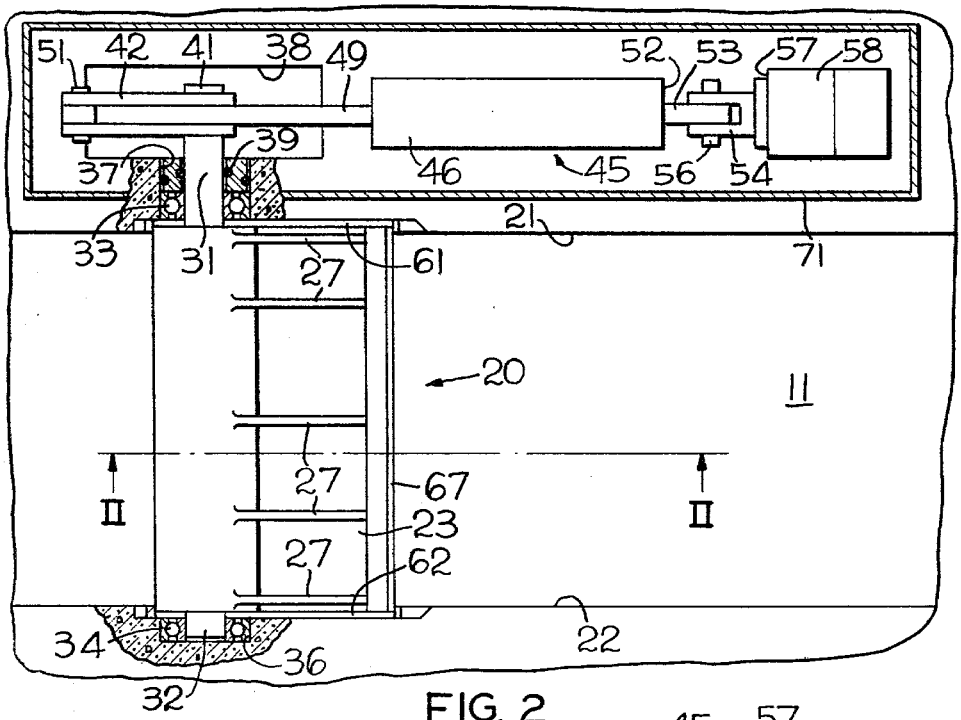
FIG. 2 is an enlarged fragmentary plan view of the canal of FIG. 1 in which the present invention is incorporated.

As shown in FIG. 2, the canal 11 is a concrete open top structure having vertical sidewalls 21 and 22. Within the canal 11, the flap-gate arrangement 20 is disposed and comprises an elongated arcuate water face portion or member 23 having one lateral edge welded or otherwise secured to an elongated cylindrical body portion 24. The upstream face 26 of the flap-gate 20 presents a convex surface to the upstream water. Reinforcement for the water face member 23 is afforded by a plurality of ribs 27 which are welded to the back face or downstream side of the water face member 23 and also to the cylindrical body portion 24 to provide additional rigidity for the relatively thin water face member 23.

As shown in the drawings, the flap-gate 20 is operable to provide for bottom discharge of the water in the canal. In this manner, the bottom discharge flowage under the ice cover will slowly melt the ice cover. The slow melting condition is highly desirable so as to prevent large pieces or chunks of ice from entering the turbine at the powerhouse. Also, the flap-gate 20 is constructed and arranged for rotary movement so that the friction between the ice cover and the gate is reduced by the rotating motion. With this concept, special de-icing procedures prior to operating the flap-gate of the present invention are not required.

As shown, the cylindrical body portion 24 is disposed high in the canal for rotation. The body portion 24 is provided with axially extending shafts 31 and 32 which are supported in bearings 33 and 34, respectively. The bearing 34 which supports the shaft 32 is disposed within a bearing recess 36 formed in the sidewall 22 of the canal. Since the bearings 33 and 34 will be within the ice zone, they must be capable of operating under low operating temperatures. A commercially available bearing suitable for the purpose is manufactured by Voest-Alpine AG. LUBRITE self-lubricating bearings, as provided by Merriman Division of Litton Industrial Products, is also suitable for the particular application herein set forth. The bearing 33 which supports the oppositely extending shaft 31 is carried within an opening 37 formed in the wall 21 of the canal. The opening 37 communicates with an operating arm recess or pit 38. To prevent seepage of water into the pit 38, a seal 39 is provided around the extending end of the shaft 31 adjacent the pit 38.

The end 41 of shaft 31 which extends into the pit 38 receives a lever arm 42 and is connected thereto by operation of a drive key (not shown). Movement of the lever arm 42 to effect rotation of the flap-gate 20 between open and closed positions is accomplished by means of a servomotor 45. As shown, the servomotor includes a cylinder 46 in which a piston 47 is supported for reciprocal movement. A piston rod 49 secured to the piston 47 extends outwardly of the cylinder 46 and is connected to the lever arm 42 by operation of a pin 51.

As shown, the head end 52 of the cylinder 46 is provided with an axially extending tang 53 which is pivotally connected to a bifurcate bracket 54 by means of a bolt or pin 56. The bracket 54 is bolted to a vertical face 57 of a thrust block 58 which is anchored to the top surface of the concrete wall structure 21 of the canal 11.

Figure 3:
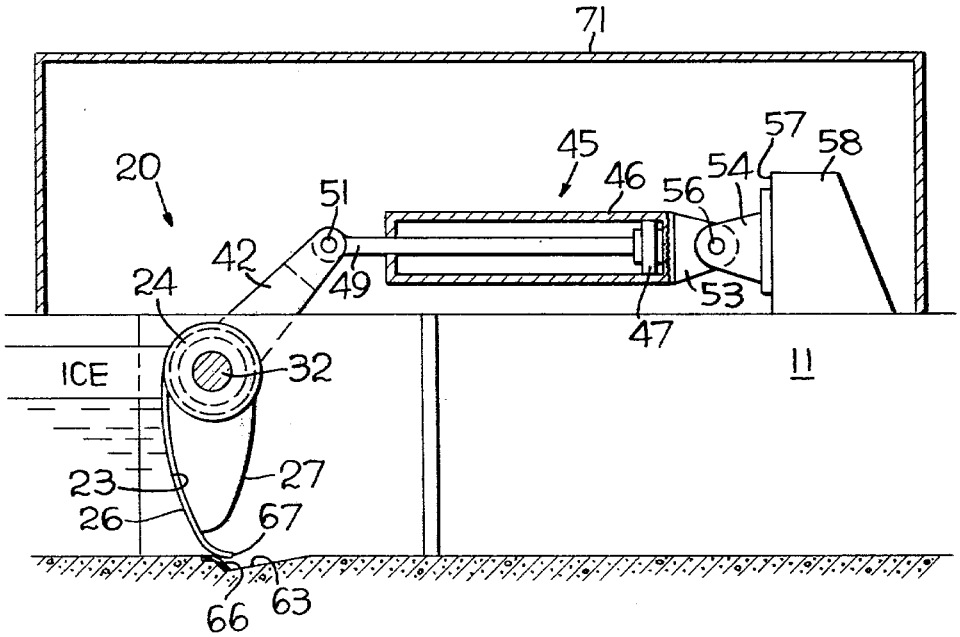
FIG. 3 is a view in vertical section through the canal taken in a plane represented by the lines III—III in FIG. 2, showing the flow control flap-gate of the present invention in a closed position.
Figure 4:
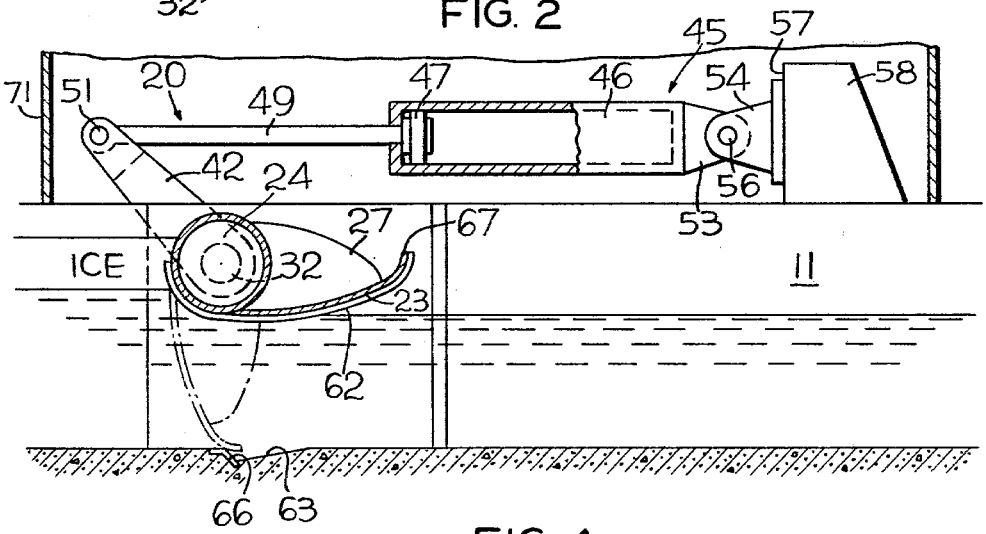
FIG. 4 is a view similar to FIG. 3, showing the flow control flap-gate in open position.

In operation with the flap-gate 20 in the closed position which it occupies, as depicted in FIG. 3, the servomotor will be pressurized on the head side of the piston forcing the lever arm 42 to rotate in a counter-clockwise direction, as viewed in FIG. 3. This action will effect rotation of the flap-gate from its closed position to an open position as depicted in FIG. 4. Should the water in the canal upstream of the flap-gate be frozen to a point of formation of an ice cap, as depicted in FIG. 3, the rotational movement of the flap-gate 20 will overcome the ice friction so as to permit movement of the flap-gate to an open position. It will be appreciated that the flap-gate 20 can be moved to any position between open and closed position so as to provide water flow control to the powerhouse 16, as desired.

Seals 61 and 62 are attached to the sides of the flap-gate structure to prevent leakage of water around the gate when in the closed position. Also, the bottom of the canal 11 is formed with a transverse recess 63. The angular upwardly sloping surface 66 of the recess 63 is provided with a seal against which the lower lip portion 67 of the flap-gate 20 engages when in the closed position. Thus, the flap-gate 20 is operable to block substantially all water flow therethrough.

Protection from the weather for the actuator 45 and the operating arm 42, as well as the pit 38, is afforded by means of an enclosing shelter 71.

The embodiments of the invention in which an exclusive property or privilege is claimed are defined as follows:

1. A bottom discharge control flap-gate for canals troubled by ice problems wherein said canal comprises a canal bottom, a first sidewall and a second sidewall cooperating to direct a flow of water from a reservoir with said water flowing with said canal between said sidewalls at a water level above said canal bottom with a layer of water at said level susceptible to freezing; the improvements comprising:

a. a water control gate having a body portion mounted within said canal between said sidewalls; said body portion being rotatable about an axis of rotation generally coplanar with said layer of water susceptible to freezing; a face member secured to said body portion and extending therefrom to said canal bottom and extending between said sidewalls; said body portion and face member cooperating to define an arcuate upstream surface with that portion of said surface within said layer of water susceptible to freezing arcing about said axis of rotation with a constant radius of arc; and, b. means for pivoting said water control gate about said axis of rotation with said face portion moving away from said reservoir and away from said canal bottom;

whereby said water control gate interrupts the flow of water through said canal when said gate is positioned with said face member extending from said body portion to said canal bottom and said gate permits flow of water through said canal when said gate is pivoted with said face member away from said reservoir with water flowing beneath said gate with said upstream surface and ice having reduced resistance to movement due to said arcuate shape of said upstream surface within said layer.

2. A bottom discharge control flap-gate according to claim 1 wherein said canal bottom is provided with a recess which extends across said canal bottom between said sidewalls with said recess generally coplanar with said axis of rotation in a generally vertical plane; said face member having a lower lip portion with an upstream face engaging a seal affixed to said canal bottom on an upstream side of said recess in sealing arrangement when said control gate is positioned with said face member extending from said body portion to said canal bottom.

3. A bottom discharge control flap-gate according to claim 2 wherein said body portion is cylindrical having a cylindrical axis coaxial with said axis of rotation; said face member having a lateral end secured to said cylindrical body portion and extending therefrom to said canal bottom with said face member having an arcuate upstream surface at said lateral end within said layer of water susceptible to freezing and said surface arcing about said axis of rotation with a constant radius of arc; and means to support said cylindrical portion for rotational movement about said axis of rotation within said canal.

4. A bottom discharge control flap-gate according to claim 3 wherein said support means includes oppositely extending axially aligned shafts carried by said cylindrical body portion;

bearings supported within suitable axially aligned openings formed in said sidewalls of said canal, said bearing being operative to receive said extending shafts to provide rotative support of said flap-gate.

5. A bottom discharge control flap-gate according to claim 4 wherein there is provided a recess in one of said sidewalls of said canal into which one of the bearing supporting openings communicate;

one of said supporting shafts that is journalled in said bearing carried in said opening that communicates with said recess being of a length to extend within said recess;

a lever arm having one end secured to said end of said shaft extending into said recess;

a servomotor operatively anchored to said canal and being connected to a free end of said lever arm to effect its movement in one direction or the other selectively to thereby rotate said flap-gate to a desired position.

* * * * *